US008477163B2

(12) United States Patent
Hirst

(10) Patent No.: US 8,477,163 B2
(45) Date of Patent: Jul. 2, 2013

(54) METALIZED RECEIVER/TRANSFER MEDIA FOR PRINTING AND TRANSFER PROCESS

(75) Inventor: Paul Hirst, Sheffield (GB)

(73) Assignee: MarvelPress, LLC, Salt Lake City, UT (US)

( * ) Notice: Subject to any disclaimer, the term of this patent is extended or adjusted under 35 U.S.C. 154(b) by 257 days.

(21) Appl. No.: 13/091,700

(22) Filed: Apr. 21, 2011

(65) Prior Publication Data

US 2012/0044312 A1 Feb. 23, 2012

(51) Int. Cl.
*B41J 11/00* (2006.01)

(52) U.S. Cl.
USPC ..... 347/172

(58) Field of Classification Search
USPC ..... 347/171, 172, 213, 215, 217
See application file for complete search history.

(56) References Cited

U.S. PATENT DOCUMENTS

| | | | | |
|---|---|---|---|---|
| 4,670,084 | A | 6/1987 | Durand | |
| 5,488,907 | A | 2/1996 | Xu et al. | |
| 6,045,646 | A | 4/2000 | Yoshikaw et al. | |
| 6,377,291 | B2 * | 4/2002 | Andoh et al. | 347/213 |
| 6,618,066 | B2 * | 9/2003 | Hale et al. | 347/172 |
| 2005/0264642 | A1 * | 12/2005 | Tischer et al. | 347/213 |
| 2011/0229664 | A1 | 9/2011 | Hoggard | |

FOREIGN PATENT DOCUMENTS

| | | | |
|---|---|---|---|
| CA | 2627228 | A1 | 5/2007 |
| GB | 2191444 | A | 12/1987 |
| WO | 9629208 | | 9/1996 |
| WO | 02072301 | A1 | 9/2002 |
| WO | 2005105470 | A1 | 11/2005 |

* cited by examiner

*Primary Examiner* — Kristal Feggins
(74) *Attorney, Agent, or Firm* — B. Craig Killough; Barnwell Whaley Patterson & Helms, LLC

(57) ABSTRACT

Media for receiving a printed image during sublimation or heat activated ink printing, and for transferring the image to a final substrate during subsequent heat transfer and activation, and a process of using the media. The media comprises a fibrous sheeting material, which can curve and conform to a three dimensional object to be imaged during the transfer printing process. A thin metal or metalized layer is to be applied onto the fabric/textile sheet shielding the fibrous structure, creating a reflective surface with excellent release properties. This reflective surface allows minimal dye penetration and excellent heat conductivity during heat transfer.

12 Claims, 3 Drawing Sheets

METALIZED RECEIVER/TRANSFER MEDIA FOR PRINTING AND TRANSFER PROCESS

This application claims priority under 35 USC §119 to GB Patent Application No. 1013877.4, filed in the United Kingdom Intellectual Property Office on 19 Aug. 2010.

FIELD OF THE INVENTION

This invention relates to a process and media for receiving a printed image, and is more particularly directed to a process and media that is useful in printing methods that use heat to fix or transfer the image to a substrate.

BACKGROUND OF THE INVENTION

Transfer printing processes involve physically transferring an image from one substrate to another, and/or fixing the image on the substrate. Transfer or fixing may involve the application of energy, such as heat energy.

One heat transfer method is melt transfer printing or release transfer printing. A design is first printed on an intermediate substrate using a waxy ink. The back side is then heated with pressure, while the printed side is in close contact with a final substrate. The ink melts onto the final substrate in the mirror image of the original image.

Another method of transfer printing involves inks or toners such as sublimation inks or toners. One form of an appropriate transfer process using liquid sublimation inks is described in Hale, et. al., U.S. Pat. No. 5,601,023, the teachings of which are incorporated herein by reference. An image is generally printed onto a paper media using heat activated dyes. Heat and pressure are applied to the back side of the media, while the image is in close contact with a final substrate. The dyes vaporize, and are preferentially diffused into and/or absorbed by the final substrate to form the image on the substrate. The image transfer of the dye depends on the vapor pressure of the dye and the rate of diffusion of the dye vapor through the layers of the paper, and the affinity as well as physical entrapment of the dye for materials such as binders, fibrous structure, and additives contained in the paper substrate. Due to the nature of the intermediate substrate, which may be a cellulose fibrous material, consumption of the heat activated dyes by the substrate may be substantial. Furthermore, affinity and entrapment of these sublimation colorants may also negatively impact the quality of the image on the final substrate, both in color intensity and in image sharpness. In the case of non-planar substrate transfer, paper substrates also create crumples, wrinkles, and creases that negatively impact image quality, and produce discontinuous images. If the paper substrate is thick, it may not conform to the transfer substrate, negating intimate physical contact, and generating unsatisfactory transfer printing results.

Attempts have been made to achieve sublimation transfer printing on 3-dimensional objects. Intermediate substrates such as thermally shrinkable plastic films and fibrous sheeting materials have been used. Drawbacks of these methods include dimensionally unstable structures, high retention of the heat activate colorants by the transfer substrate due to a high affinity of the substrate material to the colorants, or physical entrapment of color particles, poor heat conductivity, or even physical disruption during the heating process. For example, when using polyester based textile material as the intermediate transfer sheet, sublimation dyes will adhere to textile transfer sheet due to the high affinity between the sublimation dyes and polyester fibrous material. Cellulose based textile intermediate substrates also entrap sublimation dyes during transfer printing process.

Thin metal foils or metallic sheets have also been used as intermediate or image receiving transfer substrates. However, the rigid and continuous nature of metal in the form of a foil or thin sheeting is unsatisfactory in creating and maintaining close surface contact with the final (transferee) substrate, especially when the final substrate comprises curved, spherical, ovoidal or non-flat surfaces. Therefore, such intermediate or transfer substrates are not suitable for many three dimensional applications.

SUMMARY OF THE INVENTION

The present invention relates to media for receiving a printed image during sublimation or heat activated ink printing, and for transferring the image to a final substrate during subsequent heat transfer and activation. The media comprises a fibrous sheeting material, which can curve and conform to a three dimensional object to be imaged by the transfer printing process. A thin metal or metalized layer is to be applied onto the fabric/textile sheet shielding the fibrous structure, creating a reflective surface with excellent release properties. This reflective surface allows for minimal dye penetration and excellent heat conductivity during heat transfer.

An object of the invention is a receiver sheet which allows for absorption of a liquid ink to minimize smudging of the ink as it is printed and after it is printed on the receiver/transfer sheet, to create an image having true color definition and high resolution. An ink receptive layer coated on top of the metalized structure allows for the absorption of liquid inks or the acceptance of a wax thermal-type ink.

Another object of the invention is a receiver sheet which allows acceptance on its surface of an electrophotographic toner or wax thermal ink. Another object of the invention is a receiver/transfer sheet which facilitates transfer of the dye vapor toward the final substrate as the dye is sublimated. An object of the invention is a receiver/transfer sheet which will permit the use of an ink or toner formulation having a reduced concentration of dye solids. Another object of the invention is to produce a receiver/transfer sheet which will reduce the amount of energy required to transfer a printed image to a final substrate. An additional object of the invention is a receiver/transfer sheet which will reduce the image transfer time and energy input requirements. It is an object of the present invention to provide a media that will receive a sublimation or heat sensitive ink that allows the ink to be immediately wicked from the surface with minimum amount of dot gain and without feathering or bleeding of the printed image, the dye to be held on or just below the surface, improving imaging quality and dye sublimation or diffusion efficiency. It is a further object of the invention to provide a reflective layer substantially increasing the dye sublimation or diffusion efficiency, and increasing the transferred optical density onto the final substrate.

DESCRIPTIONS OF THE PREFERRED EMBODIMENTS

Figure 1:
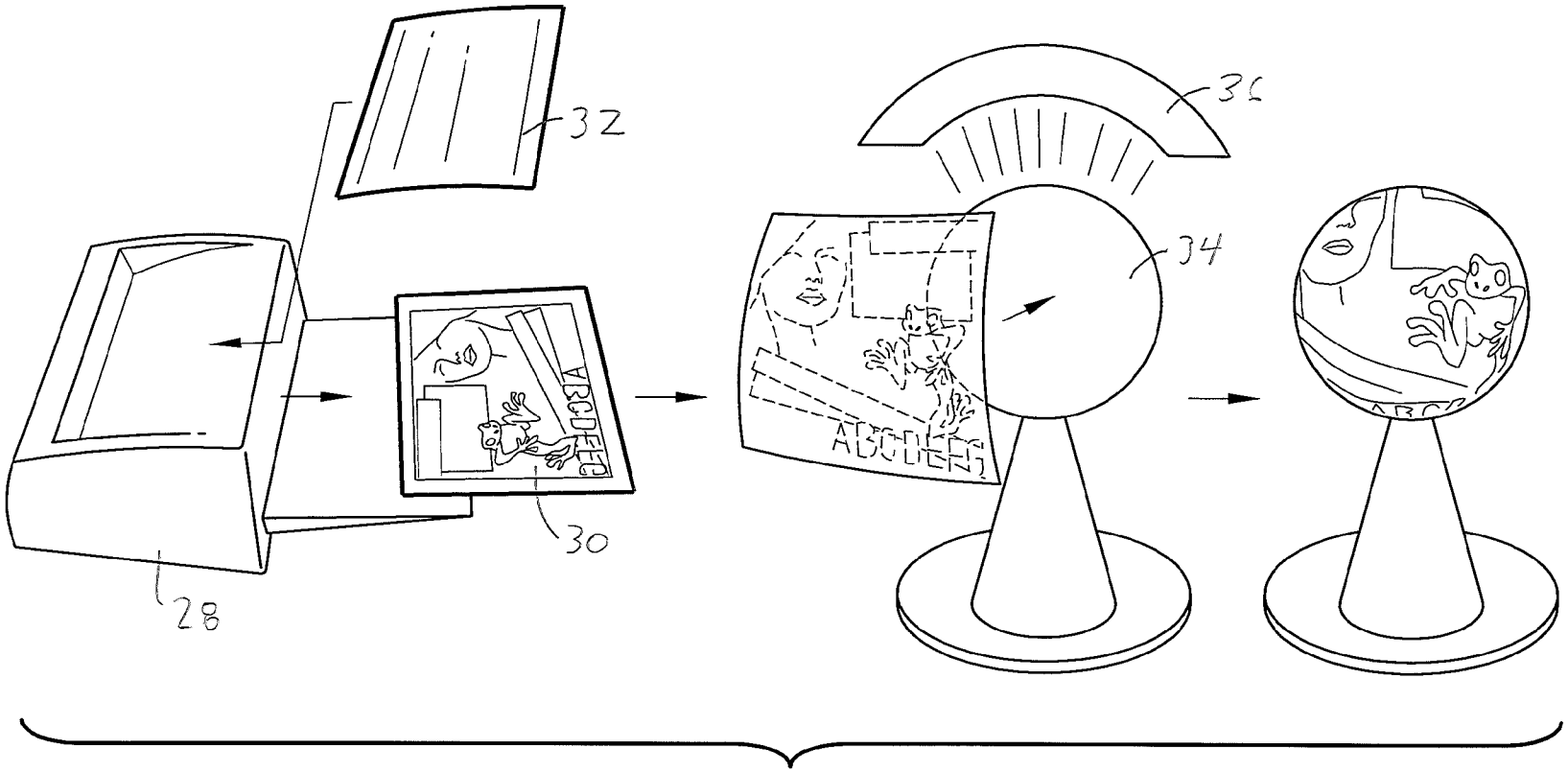
FIG. 1 shows a cross-section of a receiver/transfer media according to the invention.

In one embodiment of the present invention, an intermediate or transfer medium comprises a fabric/textile sheet or layer 2, which may be porous, and a metal layer 4 or metalized coating, which is non-porous and continuous in structure. The metalized layer shields the fiber structure. An optional ink or toner receptive layer 6 comprised of ink receptive materials, and suitable for heat activated or sublimation ink or toner printing, may be used.

The metalized transfer medium, according to the present invention, is thin in physical form, and is suitable for receiving an ink or image layer 8. The ink or image layer may be formed by printing. Digital inkjet, such as piezo ink jet, phase change inkjet, and wax thermal digital printing ink, and electrophotographic printing methods are especially useful. The transfer medium is soft and flexible, and is preferred to draping qualities that allow the substrate to conform to curved, angled, and/or three dimensional surfaces of objects that serve as the final imaged substrate. By way of example and not limitation, a golf ball may be imaged without creating wrinkles or creasing in the transfer medium that will negatively impact the image.

The metalized transfer medium is essentially dimensionally stable both during printing and the subsequent heat transfer process. Unlike shrinkable film or thermally structure sensitive fabric/textile sheeting, such dimensional integrity and stability enhances faithful and true reproduction of printed images, including photographic images, with minimal distortion through substantial physical stretch or skew under the impact of high temperature or pressure, which may be applied, for example, by mechanical force or pressure, or by vacuum.

One layer of the transfer medium, according to the preferred embodiment, is thin as compared to most print substrates, and is discontinuous. This layer may be a non-film fabric or textile sheet. Depending on the specific curvature and heat transfer conditions, the thickness of the layer may be in the range of 0.01 mm to 2.0 mm, and preferably within the range of 0.05 mm to 0.5 mm in total. Typically, the diameter of the yarn made of the fabric/textile may be 0.01 mm to 0.05 mm.

Various fabrics and textiles may be used for the present invention as the basic material. Common forms are knitted, woven, non-woven, raised or flocked fabrics may be used in a single layer or in multiple-layers. The multiple layers may be formed by lamination or by adhesive bonding. Pre-treatment processes, such as plasma, corona or electrostatic discharge, as well as chemical treatment by acid, base, latex, polymer dispersion/emulsion, nano-particle dispersion, or reactive chemical/polymieric ingredients, may also be performed prior to the metallization of the fabric/textile, as long as the treatment does not impact the properties mentioned previously. In addition, cleaning of the fibrous/textile by water, chemicals or solvents at elevated temperature may also be used.

Natural polymeric, synthetic polymeric, or a mix of polymeric or resinous materials may be used to form the fiber of the fabric/textile sheet 2. Cellulose, jute, silk, wool, acetate/tri-acetate, polyester, polypropylene, polyethylene, polyether, polyamide/nylon, synthetic cotton fiber, acrylic, etc in pure form or in mixture/blend or modified form, are among suitable materials. Materials comprising carbon or inorganic fibrous material may also be used.

At least one side of the fabric/textile sheet according to the present invention should comprise a metal layer 4. The image receiving sheet may be metalized by known methods. Depending on the specific fiber material used, either or a combination of vacuum or thermal metal vapor deposition, metal sputtering, cathodic sputtering or metal flash sputtering by plasma or electron beam, metallic ion solution reduction via wet chemical processes, and/or metal nano-dispersion coating followed by a thermal sintering process may be used to obtain satisfactory metallization of the fabric or textile to supply the required layer. At least one metallization layer may be applied to the fabric/textile sheet medium, but multiple layers of the same or different metals may also be applied in some applications.

To achieve a high release, high transfer efficiency and non-skewed high quality transfer image, the metallization of the fabric/textile material should yield a surface that is substantially non-porous, shielding the inner structure of the textile or fiber yarn from exposure to the outside environment, and ink, air, liquid or moisture. This shielding prevents chemical affinity/bonding, physical entrapment or adhering of the inks or toner to the base fiber or yarn, and enhances the transfer and energy efficiency. Shielding also decreases the negative impact from contamination, such as moisture or chemical solvent contamination. Preferably, a continuous metallization along substantially the entire surface of the fiber/yarn may be applied, which further increases the dimensional stability of the sheet, without sacrificing the softness and flexibility of the metalized medium.

Metals that may be used for the metallization process include, but are not limited to: Cu, Sn, Ni, Al, Fe, Gd, Ag, Ti, Co, Pb, etc. either in single element form or in combination. Alloys may also be used. Metals with catalyzation properties such as Pt, Pd, Rh, and rare earth metals may also be used. The final thickness of the metallization may be in the range of 0.1 to 30 microns, and is preferably between 0.5 to 5 microns for most applications. The preferred thickness allows the metalized material to maintain macroscopic properties, such as electrical and heat conductivity, and yield a material that is non-porous and non-absorptive, chemically inert and heat-stable under printing and transfer conditions according to the invention.

In one form of the embodiment, metal fibers are used to form the substrate. The metal fibers form thereby form the fabric or textile sheet. Additional metallization in this embodiment is optional.

Digital printers may be used for image generation. Most digital printers will image a print medium that is in either a roll form or a cut-sheet form. The print medium has sufficient mechanical strength and stiffness so 'pick-up' by the printer is possible. Soft and flexible fabric or textile materials may not capable of processing in these printers. In another embodiment of the present invention, an optional paper or film backing may be used to support the fibrous/textile sheet during the storage and image printing, but removed prior to the heat activation or sublimation transfer process. Cellulosic paper or plastic film may be thermally bonded or laminated to the fabric/textile sheet.

In yet another object of the present invention, an optional ink or toner retaining or receptive layer 8 may be applied on top of the metalized fabric/textile sheet. The optional inkjet or toner receptive layer receives an image printed with thermally diffusible colorant inks or toners. The image receptive layer comprises materials that receive and retain ink or toner as it is printed, either by physical entrapment or chemical reaction. This layer quickly absorbs ink drops that are associated with liquid inkjet inks, minimizing bleeding of the image, and maintaining a high definition of the image. In addition, the layer temporarily holds the thermally diffusible colorants from the ink or toner close to the surface of the transfer medium. Spreading of the ink drops is reduced, improving image resolution, and providing a higher optical density image. The image receptive layer may also act as a receiving surface for wax thermal inks. The image receptive layer may be tailored for use with known print methods. For example, materials known for forming inkjet or toner receptive paper coatings may be used according to appropriate applications.

Examples of materials that retain liquid through physical entrapment include, but are not limited to, porous materials such as silica gel, alumina, aluminum silicate, calcium silicate, magnesium silicate, zeolite, porous glass, diatomaceous earth, and vermiculite; liquid swellable materials such as montmorillonite type clays, such as bentonite and hectorite; and polysaccharides, such as starch, cationic starch, chitosan, dextrin, cyclodextrins, finely-divided organic pigments, such as polystyrene resin, ion exchange resin, urea resin, and melamine resin; and fillers, such as calcium carbonate, magnesium carbonate, kaolin, talc, titanium dioxide, zinc oxide, magnesium oxide, magnesium hydroxide, calcium hydroxide, and calcium sulfate. Examples of materials that retain liquid through chemical reaction include, but are not limited to, polymers based on methacrylate, acrylate, or the like; and monomers with suitable cross-linking agents such as divinylbenzene.

Water-soluble polymers, such as polyvinyl alcohol, modified polyvinyl alcohol, polyvinylpyrrolidinone, polyvinyl methyl ether, polyvinylbutyral, polyethylene imine, polyethylene oxide, cellulose derivatives, such as methyl cellulose, ethyl cellulose, methyl ethyl cellulose, hydroxypropyl cellulose, natural polymers, such as arabic gum, casein, gelatin, sodium alginate, and chitosin are typically used as binders. Water-insoluble polymers may be used as binders. Examples of such are styrene-butadiene copolymers, acrylic latexes, polyacrylamide, and polyvinyl acetate. The liquid retaining/receptive layer may contain chemicals which react irreversibly with water and/or solvents to render them non-volatile, for example, polyvinyl alcohol. Auxiliary agents, such as ultraviolet absorbers, thickeners, dispersants, defoamers, optical brightening agents, pH buffers, colorants, wetting agents, and/or lubricants may be included in the liquid retaining layer formulation. It is preferred that materials with little to no affinity for heat activated colorants such as sublimation dyes are used, so that the inks or dyes do not infuse or bind with the materials.

The image receptive layer comprising liquid retaining compounds and binder may be prepared in a desired ratio using one or more of the above mentioned liquid retaining compounds and binders. In one embodiment 5-50% binder is combined with 50-95% liquid retaining compound. A preferred embodiment is 5-25% binder with 75-95% liquid retaining compound. The image receptive layer may be applied to the metalized fabric/textile by known coating methods. The dry coat weight generally ranges from 1-40 $g/m^2$, and is preferably 2-15 $g/m^2$.

EXAMPLE

Coating Composition of Image Receptive Layer

| | |
|---|---|
| Polyvinyl alcohol binder | 5-50% |
| Liquid retaining compound | 50-95% |
| Physical property modify additives | 0-25% |
| liquid carrier (water) | balance |

An optional backing 26 may be used for supporting the substrate during the ink or toner printing/receiving step of the process. The backing may be applied with pressure sensitive adhesive, and removed prior to the image transfer step of the process.

An imaging transfer process may be carried out using a conventional mechanical flatbed press, as described in U.S. Pat. No. 5,431,501, or by other types of convection or radiation ovens, with or without a vacuum assist. The image printed by inks or toners comprising heat activated colorants such as sublimation dyes is kept in close contact with the transfer object, or final substrate, during the transfer process. After image transfer, the medium is removed from the object, leaving the object or final substrate imaged with a mirror image of the image that was printed on the intermediate or receiver substrate.

The use of computer technology allows substantially instantaneous printing of images. For example, video cameras or scanners may be used to capture a color image on a computer. Images created or stored on a computer may be printed on command, without regard to run size. The image may be printed on the intermediate or receiver substrate from the computer by any suitable printing means capable of printing in multiple colors, including mechanical thermal printers, ink jet printers and electrophotographic or electrostatic printers. The image is transferred or fixed as described herein.

In one embodiment, a digital printer 28 prints a reverse image 30 using ink comprising heat activated colorants on the substrate 32 comprising metal according the invention to produce an imaged transfer sheet that is imaged with heat activated colorants. FIG. 1. The imaged transfer sheet is placed over an object to be printed, such as a ball or sphere 34. The imaged transfer sheet and the object may be within a chamber 36. The shape of the chamber may be form to conform to the shape of the object to be imaged. Heat is applied to the imaged transfer sheet to activate the heat activated colorants. Heat may be radiation heating or resistance heating supplied by, or to, the chamber. The image is heat transferred from the imaged transfer sheet to the object. The imaged object 38 is ready for use.

Computers and digital printers are inexpensive, and transfers of photographs and computer generated images may be made to substrates such as ceramics, textiles, including T-shirts, and other articles. These transfers may be produced by end users at home, as well as by commercial establishments. The image may be transferred by the application of energy, such heat, as described above. An iron for clothing, or a heat press, intended to accomplish such transfers, are examples of some devices that may be used for heat transfer.

Figure 3:
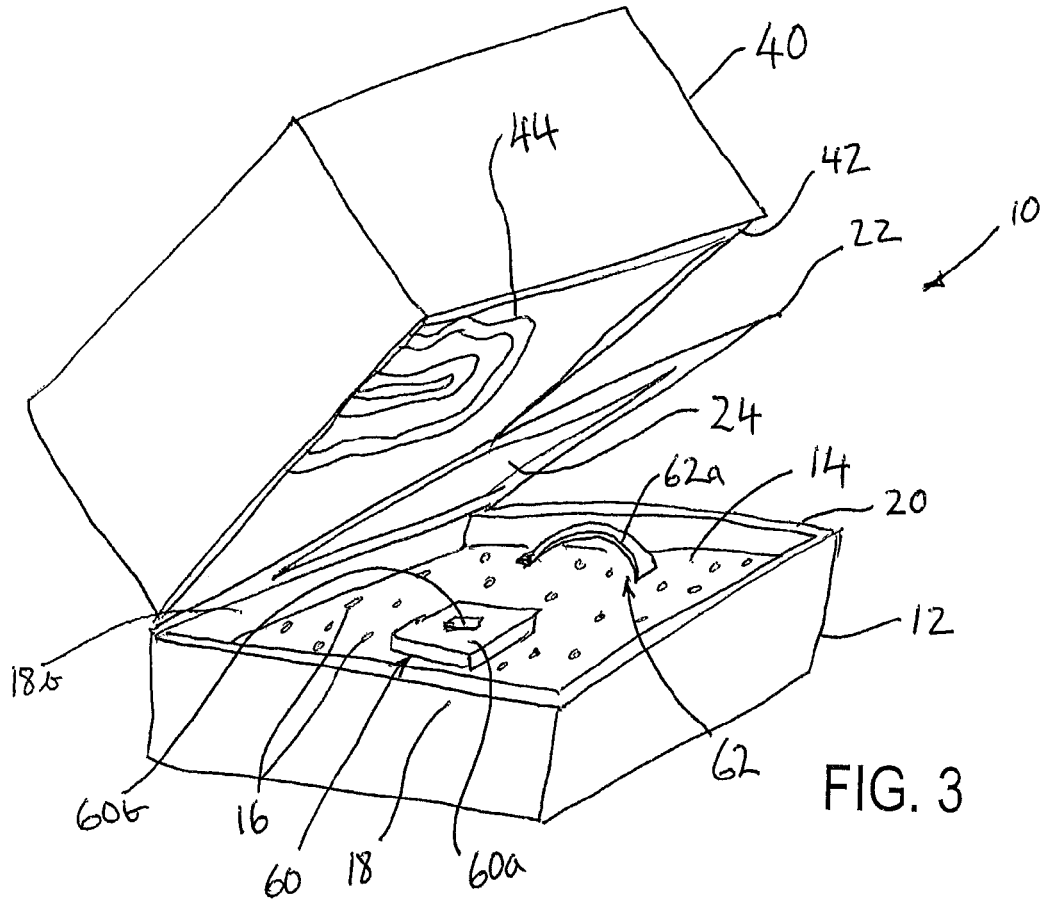
FIG. 3 is a perspective view of an open print chamber for use in the method of the invention.

FIG. 3 shows and embodiment of a device that may be used with heat transferable images. The device and method described herein are one embodiment of three dimensional printing using the metalized substrate discussed herein. A print cabinet 10, such as sold under the brand Sublideck by Octi-Tech Limited of Sheffield, England, comprises a base 12 having an internal floor 14 that is provided with a plurality of small pin-prick apertures 16. Under the floor is a vacuum pump (not visible). The base has walls 18 that terminate in a flat lip 20. The lip 20 may be rubberized and is adapted to seal against a frame 22, pivoted at the rear wall 18*b* of the base. The frame is adapted to capture and hold a film 24 of APET. When the frame is closed against the lip a lid 40 of the cabinet can close, its lower edge 42 capturing the frame against the lip and completing the seal of the frame against the lip. Inside the lid are infra-red heater elements 44. However, convection or other heaters could also be employed. However, convection or other heaters could also be employed.

Figure 4:
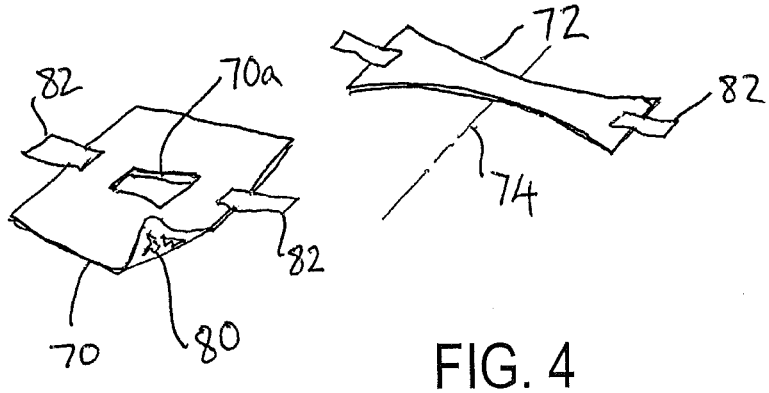
FIG. 4 is perspective views of exemplary transfer sheets for a light switch and cabinet handle.

Items that are to be printed are multifarious and two are shown by way of example. The first is a light switch 60 and the second a cabinet door handle 62. Shown in FIG. 4 are two transfer sheets 70,72 shaped to fit on corresponding surfaces of the switch and handle. Sheet is sized to fit the face plate, having a cut-out 70*a* to surround switch lever 60*b*. A separate small sheet of transfer material could be provided for that, if desired. Sheet is similarly sized and shaped to fit the front face 62*a* of the handle which, in this case is flat other than in having a single dimensional curvature parallel an axis 74 of the sheet. Consequently, the sheet can conform to that curvature without creasing.

Figure 2:
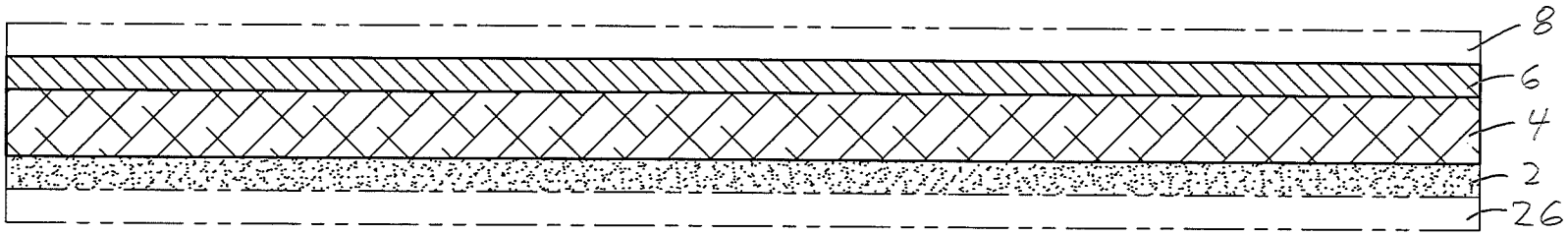
FIG. 2 demonstrates an embodiment of a three dimensional heat activated transfer printing process according to the invention.

The transfer sheets are printed in reverse, on their underside (print receptive side) with an image 80. FIG. 2. The image is most likely printed before the sheets are cut to size, but this is optional in many cases. Strips of adhesive tape 82 are applied to the sheets and they are positioned and fixed temporarily in place using the tapes on the objects respectively. The objects are then loaded onto the floor of the cabinet 10 in as many number as fit with a small clearance between them. There is no requirement for any precision in the fitting and the objects can be loaded determined only by their optimal fit on the floor.

The frame 22 is then loaded with an APET sheet and closed against the lip above the objects. The height of the walls 18 is selected so that the film approximately touches the top of the objects. Indeed, the height may be adjustable to suit different objects by arranging for selective raising and lowering of the floor. When the lid is closed, a program may be activated that first energizes the infrared heaters (or other heating methods) to heat the film to above its Vicat softening point (generally in the region 50-100° C. Once that is reached, the vacuum pump is activated and atmospheric pressure with the lid part of the chamber 10 presses the softened film so that it surrounds and presses against the objects intimately engaging the transfer sheets with the respective surfaces to be imaged. Finally, when the vacuum extraction is complete, the heaters are further energized to raise the temperature to above the activation point of the sublimation inks used. This is generally in the region of 150-200° C.

After a suitable period of perhaps 5 to 10 minutes, the heating is stopped and the vacuum released. The cabinet is opened and the frame lifted. The sheet of APET film is peeled from the floor 14 and from the objects. So also is the transfer sheets and an effective print of the surfaces is found.

The APET film used was: Amorphous Polyethylene Terephthalate (APET). The transfer sheet was: Visi Jet transfer paper.

The ink was: Visi Sub Sublimation Ink.

The first stage temperature was 80° C., reached and held for a period of 20 seconds.

The vacuum was 0.7 bar, resulting in a generalized pressure of 0.7 bar, and this was held for a period of 5 minutes.

The activation temperature was 160° C., reached and held for a period of 5 minutes.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

What is claimed is:

1. A method of printing on three dimensional objects, the method comprising:

employing a digital printer to print a reverse image using ink comprising heat activated colorants on a substrate comprising metal to produce an imaged transfer sheet imaged with heat activated colorants;

temporarily applying the imaged transfer sheet to the object over an area of the object to be printed;

positioning the imaged transfer sheet and object within a chamber;

evacuating air within the chamber to assist in pressing the imaged transfer sheet into intimate contact with the object; and applying heat to the imaged transfer sheet and activating the heat activated colorants so that the image is transferred from the imaged transfer sheet to the object.

2. A method according to claim 1, wherein the substrate comprises a textile.

3. A method according to claim 1, wherein the substrate comprises a textile layer and a metalized layer, and wherein the textile layer is opposite the metalized layer from the image.

4. A method according to claim 1, wherein the substrate comprises a textile layer, an ink receptive layer and a metalized layer, and wherein the textile layer is opposite the metalized layer and the ink receptive layer from the image.

5. A method according to claim 1, further comprising the step of cutting the substrate to conform to contours of the object prior to temporarily applying the imaged transfer sheet to the object over an area of the object to be printed.

6. A method according to claim 1, further comprising the steps of:

providing a heat softenable and flexible film;

positioning the film over the imaged transfer sheet and heating; and softening the film while the imaged transfer sheet and object are in the chamber and prior to evacuating air within the chamber.

7. A method according to claim 6, wherein the film is a polyester film.

8. A method according to claim 6, wherein the film is Polyethylene Terephthalate (PET), preferably Amorphous Polyethylene Terephthalate (APET).

9. A method according to claim 1, wherein the imaged transfer sheet is temporarily affixed to the object by adhesive tape.

10. A method as claimed in claim 1, wherein the heat is applied to the imaged transfer sheet by infra-red heaters.

11. A method according to claim 1, wherein the substrate comprises a textile, and the textile has sufficient draping property to press the imaged transfer sheet into intimate contact with the object.

12. A method according to claim 1, wherein the substrate comprises a textile layer and a metalized layer, and wherein the textile layer is opposite the metalized layer from the image, and the textile layer has sufficient draping property to press the imaged transfer sheet into intimate contact with the object.

* * * * *